US005813086A

United States Patent [19]

Ueno et al.

[11] Patent Number: 5,813,086

[45] Date of Patent: Sep. 29, 1998

[54] CARPET CLEANER AND METHOD FOR CLEANING CARPETS

[75] Inventors: Saburo Ueno; Sumio Morikawa; Hiroyuki Satone, all of Osaka, Japan

[73] Assignees: Oyodo Komatsu Co., Ltd; Sun Food Laboratory Inc., both of Japan

[21] Appl. No.: 584,837

[22] Filed: Jan. 11, 1996

[30] Foreign Application Priority Data

Oct. 23, 1995 [JP] Japan ..... 7-318657

[51] Int. Cl.[6] ..... A47L 11/284

[52] U.S. Cl. ..... 15/320; 15/345; 15/353; 15/384

[58] Field of Search ..... 15/320, 321, 353, 15/345

[56] References Cited

U.S. PATENT DOCUMENTS

| | | | |
|---|---|---|---|
| 3,392,418 | 7/1968 | Schowalter | 15/320 |
| 3,676,889 | 7/1972 | Edlin | 15/320 |
| 3,774,262 | 11/1973 | Anthony et al. | 15/345 X |
| 3,940,826 | 3/1976 | Phillips et al. | 15/320 |
| 4,000,536 | 1/1977 | Nayfa et al. | 15/320 X |
| 4,167,798 | 9/1979 | Klugl et al. | 15/320 |
| 4,369,544 | 1/1983 | Parisi | 15/320 |
| 4,595,420 | 6/1986 | Williams et al. | 15/320 X |

FOREIGN PATENT DOCUMENTS

| | | |
|---|---|---|
| 48-59756 | 5/1973 | Japan . |
| 51-11430 | 4/1976 | Japan . |
| 51-36549 | 10/1976 | Japan . |
| 52-199213 | 5/1977 | Japan . |
| 55-76628 | 6/1980 | Japan . |
| 55-81632 | 6/1980 | Japan . |
| 56-29536 | 7/1981 | Japan . |
| 58-2273 | 1/1983 | Japan . |
| 3224530 | 10/1991 | Japan . |
| 5199961 | 8/1993 | Japan . |
| 570443 | 9/1993 | Japan . |

*Primary Examiner*—Chris K. Moore
*Attorney, Agent, or Firm*—Morrison Law Firm

[57] ABSTRACT

A carpet cleaner for cleaning carpets includes a foam generation unit, roller brushes and a heated air drying mechanism. The foam generation unit uses multiple stages of foam generation for creating a very fine foam which is applied to the carpet. A suction device removes excess foam from the carpet after the brushes have gone over the carpet. Finally, heated air is blown across the carpet after the suction device has removed the excess foam. The carpet is cleaned, dried and ready for immediate use.

18 Claims, 3 Drawing Sheets

CARPET CLEANER AND METHOD FOR CLEANING CARPETS

BACKGROUND OF THE INVENTION

The present invention relates to industrial carpet cleaners that generate cleaning foam, feed the foam to a carpet, clean the carpet with rotating brushes, and dry the carpet at high-speed.

The table below is a comparison of the present invention and 11 utility model publications relating to carpet cleaners filed in Japan.

TABLE 1

| Prior Art Reference Number: | Differences between the prior art and the present invention |
|---|---|
| Japanese Examined Patent Publication number 51-11430 | This prior art is solely the description of the valve in a suction device. |
| Japanese Examined Patent Publication number 51-36549 | This prior art is a method for collecting lint from dry cleaning. |
| Japanese Examined Patent Publication number 48-59756 | This reference uses a vacuum, vibration and static to suction trash. |
| Japanese Examined Patent Publication number 52-19913 | This is a dry cleaner combining a brush and a beater. |
| Japanese Examined Patent Publication number 56-29536 | This reference relates to Japanese Examined Patent Publication number 52-19913. |
| Japanese Examined Patent Publication number 55-76628 | This reference raises fibers with steam and performs brushing. |
| Japanese Examined Patent Publication number 55-81632 | This prior art does not include roll or brushing mechanisms. |
| Japanese Laid-Open Publication number 3-224530 | This reference includes no mechanisms for brushing. |
| Japanese Laid-Open Publication number 5-199961 | The cleaner itself is rotated in reverse. |
| Japanese Utility Model Laid-open Publication number 5-70443 | The building itself has cleaning properties. |
| Japanese Utility Model Examined Publication 58-2273 | Foam retrieval. No drying function. |

Many of the above prior art references relate to small, dry carpet cleaners for home use. None of them cover the object of the present invention: an industrial carpet cleaner having foam generation and feeding, cleaning with a rotating brush, and high-speed drying.

The U.S. patents relating to carpet cleaners, described below, can be divided into four categories:

1) Foam method using a foam cleaning agent or shampoo method;
   U.S. Pat. No. 3,079,285; U.S. Pat. No. 3,364,627; U.S. Pat. No. 3,392,418; U.S. Pat. No. 4,000,537; U.S. Pat. No. 4,167,798; U.S. Pat. No. 2,910,720
2) Steam method or hot-water method;
   U.S. Pat. No. 3,614,797; U.S. Pat. No. 3,699,607; U.S. Pat. No. 3,919,729; U.S. Pat. No. 3,959,844; U.S. Pat. No. 3,974,541
3) Combination of foam cleaning agent or shampoo with hot-water method;
   U.S. Pat. No. 4,167,799; U.S. Pat. No. 4,353,145
4) Related patents (floor resin coaters and the like);
   U.S. Pat. No. 5,169,445

Although they are separated into four types, each of the above patents disclose devices having motor frames, wheels, devices for feeding a cleaning agent to the carpet surface, and driving mechanisms. Each of the disclosed devices has drawbacks accompanying its advantages as an industrial carpet cleaner. For example, in all of the prior art references, it is necessary to feed a liquid cleaning agent to the carpet surface. Because the cleaning agent is liquid, a lot of moisture remains within the carpet, even after vacuuming. Since the prior art references include no drying process involving high-temperature or high-speed air, a long period of natural drying is needed to adequately dry the carpets. This prevents use of the carpet immediately after cleaning.

The carpet cleaning device disclosed in U.S. Pat. No. 4,167,798 uses a foam cleaning agent. Exhaust air from a blower is divided in two streams. One stream blows air which is used to create the foam. The other stream of air drives the cleaning brush. There is no disclosure relating to the generation of very fine foam. Also, there is no mechanism for instantaneous drying of the carpet using high-temperature or high-speed air. Thus, the carpet cannot be used immediately after it is cleaned.

In the floor resin coating machine in U.S. Pat. No. 5,169,445, a drying device dries the coating film with air heated to 60 degrees C., and also blows room-temperature air. The purpose of this machine is not to clean carpets and the drying device of this device is not effective at all in drying thicker carpets with long fibers. The moisture between the carpet fibers is retained by capillary action which also binds carpet fibers together, making it difficult to dry the carpet.

Thus, the disclosed devices do not show a compact, integrated high-performance industrial carpet cleaner system in which the carpet can be used immediately after cleaning. A product with these attributes has been long-awaited by many in the carpet cleaner industry and no such integrated industrial device is available in the market.

The general method for generating very fine chemical cleaning agent foam has been to seal a cleaning agent and high-pressure natural gas in a high pressure metal container. This is then blown out to form a very fine foam. However, for the safety of the operator, it is undesirable to use a high pressure tank.

In addition, many of the conventional carpet cleaners use a single rotating disk shaped brush. This configuration generates torque that makes the carpet cleaner hard to control and the carpet cleaner easily veers off course.

Cleaning dirty carpets is generally performed with a number of people in the following sequence: 1) manual application of a cleaning agent; 2) foaming on the carpet, friction cleaning using a horizontal rotating brush; 3) suction of surplus cleaning agent using a vacuum nozzle; 4) air-drying of carpet for five or six hours.

Both carpet cleaning workers and those in the carpet cleaning industry seek some sort of improvement in the time and expensive labor involved.

OBJECT AND SUMMARY OF THE INVENTION

The object of the present invention is to overcome the drawbacks of the conventional technology and to provide a high-performance semi-automatic industrial carpet cleaner that a single worker can easily operate.

Another object of the present invention is to include a carpet dryer in the carpet cleaning device so that the carpet is dried is ready for use immediately after cleaning.

Yet another object of the present invention is to produce a very fine foam at relatively low pressure, thereby reducing risk to the operator.

Briefly stated, a carpet cleaner for cleaning carpets includes a foam generation unit, roller brushes and a heated air drying mechanism. The foam generation unit uses multiple stages of foam generation for creating a very fine foam which is applied to the carpet. A suction device removes excess foam from the carpet after the brushes have gone over the carpet. Finally, heated air is blown across the carpet to dry the carpet, after the suction device has removed the excess foam. The carpet is cleaned, dried and ready for immediate use.

According to an embodiment of the present invention, there is described, a cleaning device comprising: a chassis, means for applying a cleaning agent to a surface, means for scrubbing said cleaning agent into said surface, means for removing excess cleaning agent from said surface, said means for removing mounted behind said means for scrubbing, means for drying said surface, said means for drying including means for blowing air on said surface, and said means for drying mounted behind said means for removing.

According to another embodiment of the present invention, there is described, a carpet cleaner for cleaning a carpet comprising: a chassis having wheels and casters, a cleaning agent tank mounted on said chassis, a foam applicator, a duct connecting said foam applicator and said cleaning agent tank, means for transforming said cleaning agent into a foam, said means for transforming mounted in said duct, means for discharging said foam from said foam applicator onto said carpet, brushes movably mounted on said chassis, means for moving said brushes relative to said carpet, means for removing excess foam from said carpet, said means for removing mounted on said chassis rearward from said brushes, means for drying said carpet mounted rearward from said means for removing excess foam, a handle, said handle allowing manual movement of said carpet cleaner, and a control panel including controlling means for selectively starting and stopping said means for applying said foam, means for moving said brushes, means for removing excess foam, and means for drying said carpet.

According to yet another embodiment of the present invention, there is described, a carpet cleaner for cleaning carpets comprising: a chassis, means for applying a cleaning agent to said carpet, means for scrubbing said carpet, suction means for removing excess cleaning agent from said carpet, a compressor, an air duct, a heater, means for directing said air from said compressor to said heater effective to generate hot air, and means for blowing said hot air from said heater onto said carpet for drying said carpet.

The present invention relates to a carpet cleaner that includes: a device producing and blowing out very fine foam containing a chemical cleaning agent which is stable over a long period of time; a device using rotating brushes performing friction cleaning of a carpet on which the foam has been blown and scattered; a device sucking in residual cleaning agent foam on the carpet and the rotating brush and passing into a defoaming tank in order to prevent secondary foaming; and a device for quickly drying the cleaned carpet surface with a high-temperature, high-speed air current.

The present invention also relates to a carpet cleaner integrally combining: a device producing a very fine foam cleaning agent that is stable, has large bulk, and that has strong cleaning action allowing it to clean deep into the carpet with only a small amount of the cleaning agent; a feeding device feeding the foam cleaning agent to the carpet surface; and a high-temperature, high-speed jet drying device which performs vacuum suction on residual foam and moisture after brushing, and which instantly dries residual cleaning agent foam on the carpet and on the rotating brush using a high-temperature and high-speed air current at 70 degrees C. to 200 degrees C.

Other embodiments of the present invention include the following:

1) Production of very fine foam using a multi-step foam generating method, where the foam contains chemical cleaning agents and is stable over a long period of time. Also, a device blowing out this foam.
2) A device that uses a rotating brush to perform friction cleaning of a carpet surface, on which has been blown and scattered a very fine foam having chemical cleaning agents and long-term stability.
3) A device that sucks up residual cleaning agent foam on the carpet and on the rotating brush and puts the foam in a defoaming tank, thus preventing secondary generation of foam.

In addition, the present invention includes a multi-step foam generation method to stably and continuously produce very fine foam from chemical cleaning agent preparations. The very fine foam is fed to the carpeting on the floor and friction cleaning is performed on the carpet with a rotating brush. The residual cleaning agent and foam from the carpet is sucked into a sealed tank. This prevents secondary generation of the foam within the tank, while keeping the fluid level within the cleaning agent tank to a fixed level automatically. Air that is sucked out of the tank with a vacuum pump is combined with air from the atmosphere, and a high-speed air flow is formed with a turbo fan. The air is heated to a temperature of approximately 70 degrees C. to 200 degrees C., traveling at 4 m/sec to 20 m/sec. A jet air nozzle is used to further accelerate the air flow. The air is ejected at a high-speed and quickly dries the carpet.

Figure 1:
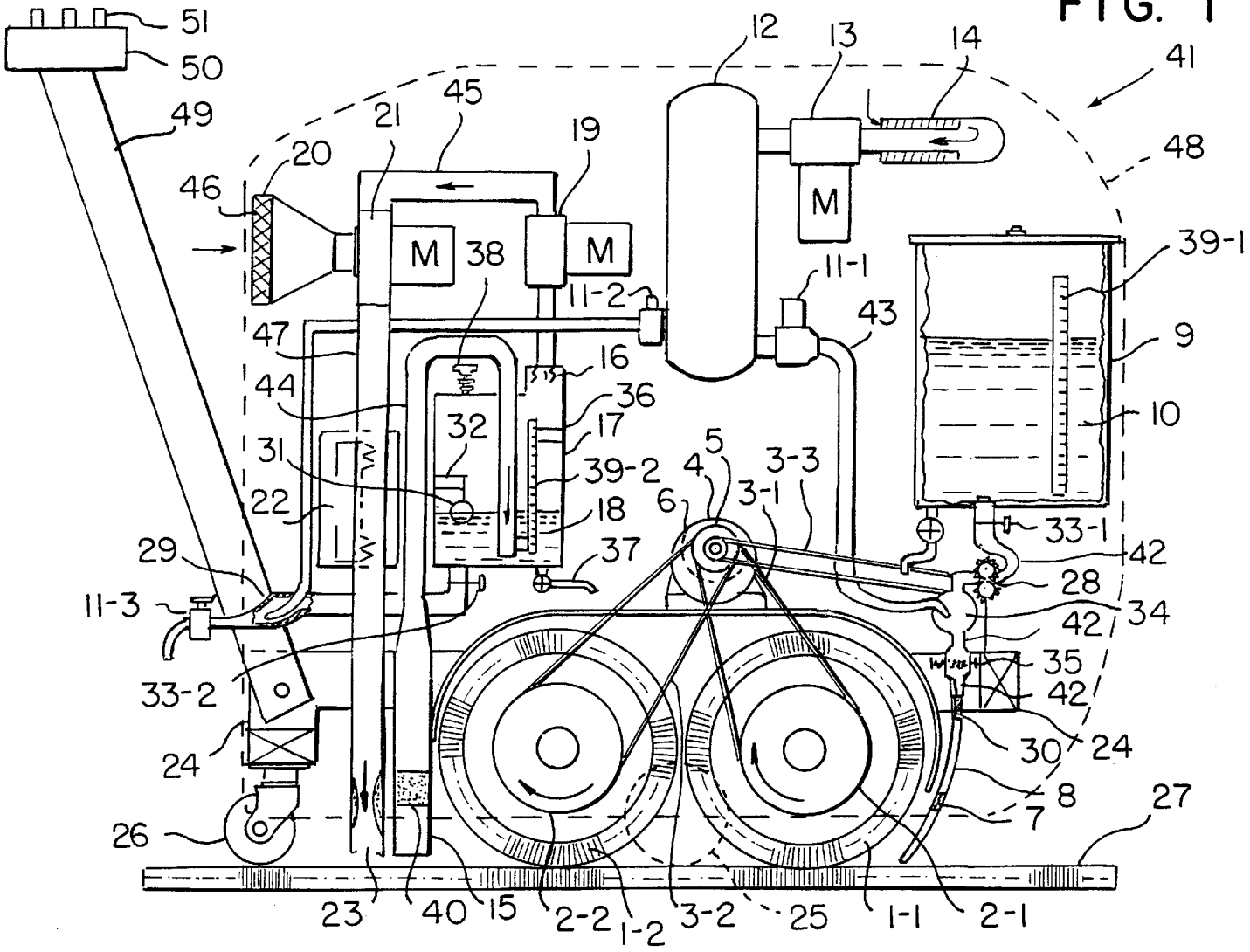
FIG. 1 is a side-view drawing of a carpet cleaning device using roller rotating brushes.
Figure 3:
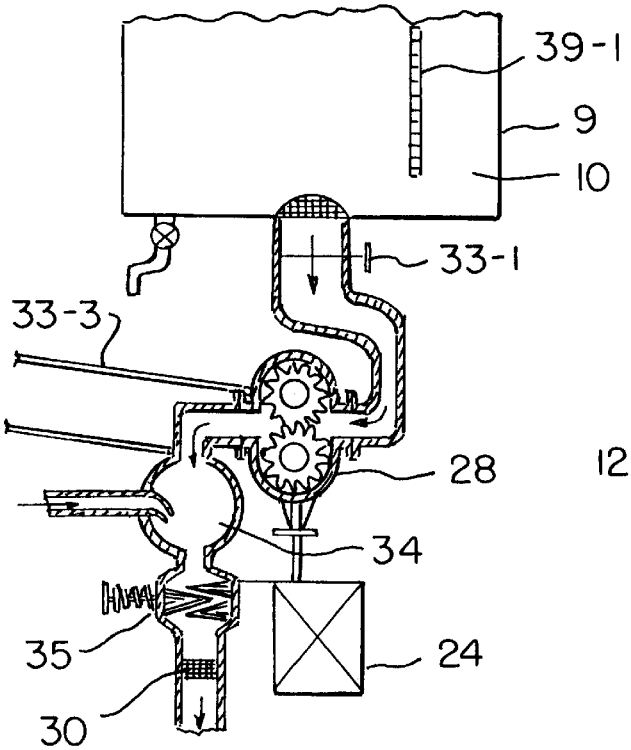
FIG. 3 is an enlarged cross-section drawing of the region around gear pump 28 and spring valve 35 used in the carpet cleaning device of the present invention.
Figure 4:
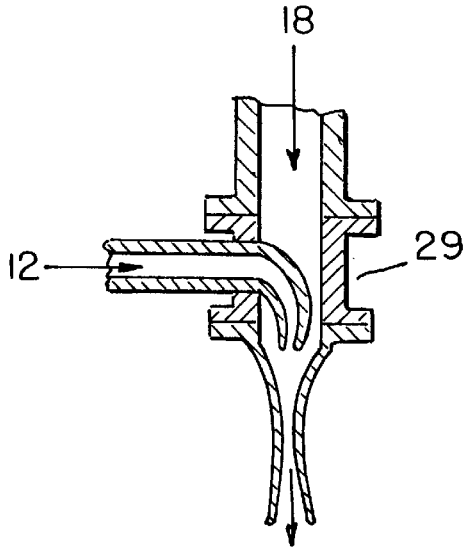
FIG. 4 is an enlarged drawing of the region around Venturi nozzle 29 for the carpet cleaning device of the present invention.

DETAILED DESCRIPTION OF THE PREFERRED EMBODIMENTS:

Referring to FIG. 1, a frame 24, including wheels 25 and free casters 26, movably supports a carpet cleaner 41. Referring also to FIGS. 3 and 4, a device producing and blowing out very fine foam, containing chemical cleaning agents, which is stable over a long period of time, includes an open cleaning agent tank 9 attached on frame 24. A check valve 33-1, a pressurizing pump 28, a foaming space 34, and a spring valve 35 are connected in sequence to the bottom of tank 9 via a cleaning agent duct 42. Cleaning agent duct 42 also houses a metallic mesh 30 and a foam cleaning agent nozzle 8 having a foaming sponge 7. The tip of foam cleaning agent nozzle 8 opens near the surface of a carpet 27.

Metallic mesh 30 has a size 50–100 mesh. The foaming sponge is a plastic sponge having very fine continuous pores such as urethane foam.

Pressurizing pump 28 is a gear pump rotated by a belt 3-3. A geared motor 6 disposed on frame 24 drives belt 3-3.

A liquid foam cleaning agent 10, containing 0.005 percent lauryl alcohol added to 0.1 percent lauryl sodium sulfate, flows into cleaning agent duct 42 from the bottom of cleaning agent tank 9. From there liquid foam cleaning agent 10 flows through check valve 33-1 and pressurizing pump 28, driven by belt 3-3, into foaming space 34. Spring valve 35 maintains liquid foam cleaning agent 10 at a pressure of approximately 1–2 kg/cm$^2$ in foaming space 34.

It is important that the composition for the chemical cleaning agent be strong and generate very fine foam that is stable over a long period time. It is not necessary that liquid foam cleaning agent 10 contain 0.005 percent lauryl alcohol added to 0.1 percent lauryl sodium sulfate. Instead, foam cleaning agent 10 could be any cleaning agent that exhibits the desirable characteristics. Examples of foaming agents that exhibit the desirable characteristics are: 1) anionic surface active agents such as alkyl sulfate, alkyl ester sulfate, polyoxyethylene alkyl ether sulfate, alkyl allyl sulfonate; 2) non-ionic surface active agents such as alkyl phenol-based; 3) ampholytic surface active agents such as alkyl dimethyl aminoacetic acid betaine, alkyl dimethyl amine oxide; 4) higher order fatty alcohol; 5) a combination of anionic surface active agents and ampholytic surface active agents. Combinations of two or more of examples 1), 2), 3), 4), and 5) above may also be used.

Air passes through a filter silencer 14, is moderately compressed by a compressor 13 (at a pressure of approximately 2–3 kg/cm$^2$), and is delivered to an air tank 12. A solenoid valve 11-1 permits air to be transferred from air tank 12 to foaming space 34 via a first air duct 43, when solenoid valve 11-1 is in an open position.

Foam cleaning agent liquid 10 undergoes an initial foaming under pressure (with a foam diameter of approximately 5–10 mm) as the pressurized air is transferred to foaming space 34. When the pressure inside foaming space 34 exceeds 1–2 kg/cm$^2$, spring valve 35 opens, and secondary foaming of liquid foam cleaning agent 10 takes place at metallic mesh 30 below spring valve 35 (with a foam diameter of approximately 1–2 mm). Foam cleaning agent liquid 10 that has passed through foam cleaning agent nozzle 8 undergoes a tertiary foaming (with a foam diameter of 0.5 mm or less) at foaming sponge 7. Foaming sponge 7 is made from urethane and contains continuous foaming holes. This three-stage foaming provides continuous fine foam feed to carpet 27 that has strong cleaning effects, has low apparent specific gravity, and is stable over a long period of time.

The diameter of the foam can be measured using a microscope micrometer.

When solenoid valve 11-1 is closed and pressurizing pump 28 is stopped, spring valve 35 and check valve 33-1 automatically close, and the foaming system is halted. Thus, liquid foam cleaning agent 10 is prevented from leaking onto carpet 27 and compressed air from air tank 12 is prevented from blowing into cleaning agent tank 9.

A fluid level within cleaning agent tank 9 can be inspected from outside carpet cleaner 41 with a fluid level meter 39-1.

Pressurizing pump 28 is a gear pump in the preferred embodiment but other types of pumps, such as vane pumps, can also be used. Similarly, diaphragm valves and other types of valves with pressure regulating capabilities can be used in place of spring valve 35. It is also desirable for foaming space 34 to be spherical but foaming space 34 can have other shapes. A cylindrical, cone-shaped, or rectangular space can also be used.

The above description illustrates a tertiary foaming method. However, as long as a very fine foam having a diameter of 0.5 mm or less can be formed from the cleaning agent, a combination of the primary and secondary foaming steps, a combination of the primary and tertiary foaming steps, or a foaming method using more than three steps can be used, if desired.

Using the preferred embodiment, a bulk specific density of the foam is approximately between 0.01 and 0.1 g/ml, with a desirable value being approximately 0.03 g/ml. Thus, 1 g of liquid foam cleaning agent 10 would have a bulk of approximately 33 ml. A very small amount of liquid foam cleaning agent 10 cleans a large carpet area. The foam is very stable so that even under high summer temperatures of 35 degrees C., the foam maintains 50 percent of its initial bulk for at least 20 minutes.

A first roller rotating brush 1-1 and a second roller rotating brush 1-2 are used for friction cleaning on carpet 27. A pulley 4 and a pinion gear 5 mounted on geared motor 6 transfer rotational movement of geared motor 6 through belts 3-1 and 3-2, to pulleys 2-1 and 2-2, respectively. Pulleys 2-1 and 2-2 rotate first roller rotation brush 1-1 and second roller rotation brush 1-2, respectively.

The rotation of first roller rotation brush 1-1 and second roller rotation brush 1-2 performs friction cleaning of the surface of carpet 27, on which foam has been applied via foam cleaning agent nozzle 8.

Figure 2:
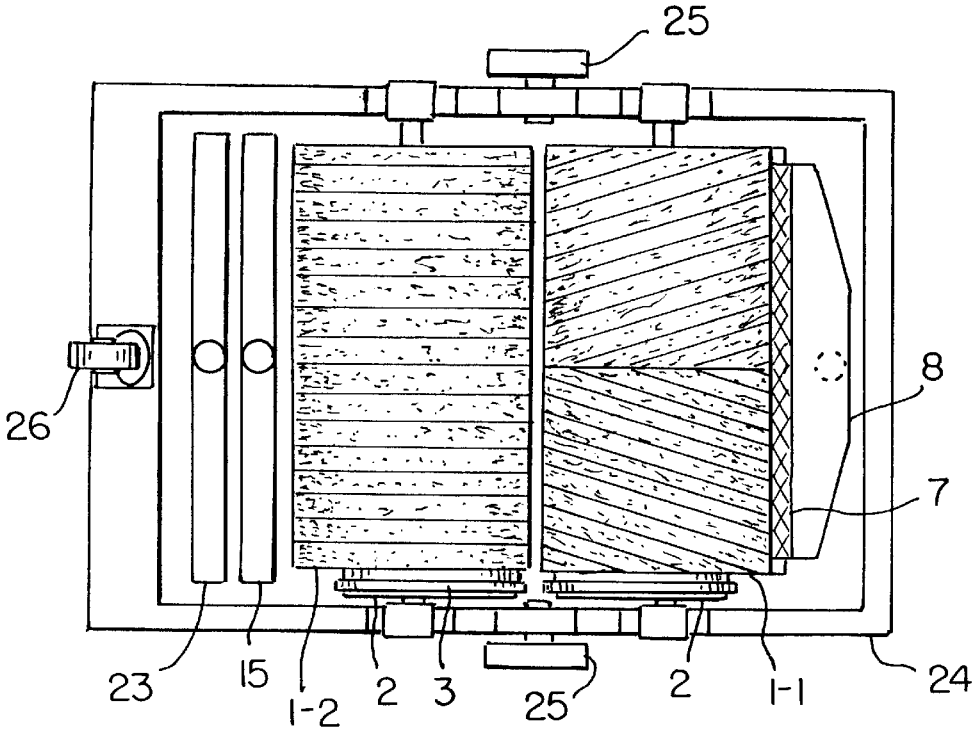
FIG. 2 is a bottom-view drawing of the roller rotating brush for the carpet cleaning device of the present invention, illustrating the orientation of the bristles on the brush.

Referring to FIG. 2, first roller rotation brush 1-1 has its bristles oriented linearly inward at an angle of approximately 20–60 degrees symmetrically from the center. Second roller rotation brush 1-2 has its bristles oriented in straight lines from the front to the back. When cleaning is performed on carpet 27, which has been dishevelled by use, roller rotation brushes 1-1 and 1-2 perform friction cleaning while also neatly orienting the carpet fibers parallel to the direction of movement of carpet cleaner 41. The orientation of the carpet fibers improves the effectiveness in cleaning and also simplifies the drying that is performed at the final stage.

The preferred embodiment discloses two roller rotation brushes as shown in the drawings. However, three or more brushes can also be used to perform friction cleaning of carpet 27 and orient the carpet fibers.

Figure 5:
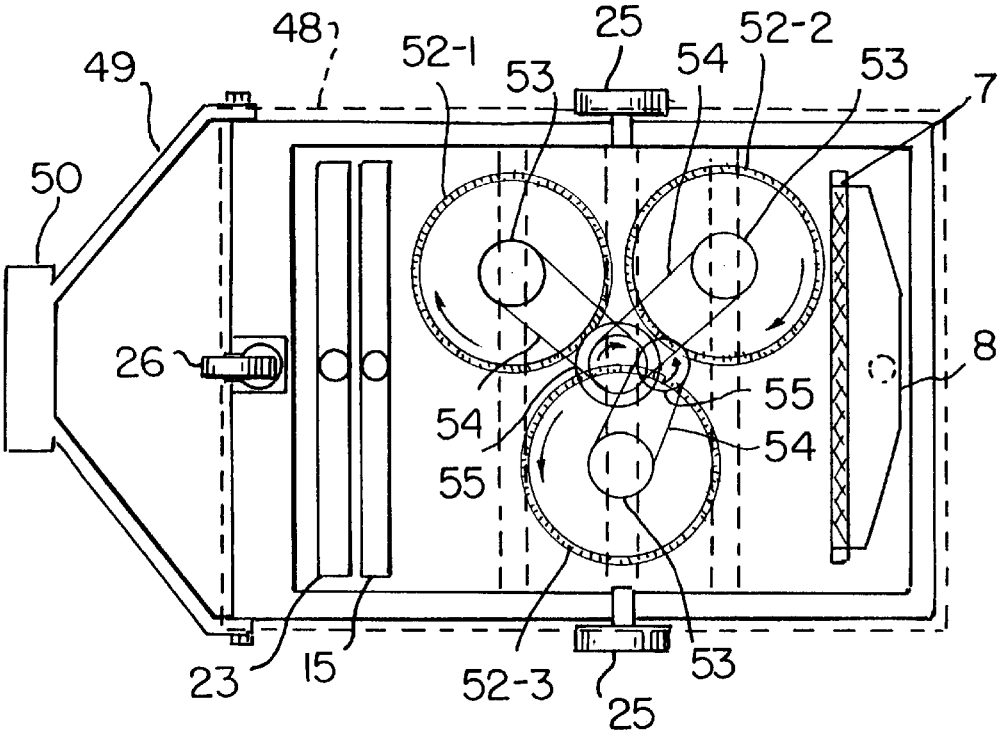
FIG. 5 is a bottom-view drawing of a carpet cleaning device using a disc-shaped horizontal rotating brush of the present invention.

Referring to FIG. 5, a plurality of disc-shaped horizontally rotating brushes that rotate parallel to the floor surface can also be used instead of roller rotating brushes 1-1 and 1-2. The rotation of geared motor 6 is transferred from a pinion gear 55, through belt 54, to pulleys 53. The pulleys 53 rotating disc-shaped horizontal rotating brushes 52-1, 52-2 clockwise as seen from the floor, and rotating disc-shaped horizontal rotating brush 52-3 counterclockwise.

Although three disc-shaped horizontal brushes are shown, two or more disc-shaped horizontal rotating brushes, alternately rotating in opposing directions, would perform the same function as described above.

The disc-shaped horizontal rotating brushes have bristles that are oriented in a spiral shape starting from the center.

A device that removes residual liquid foam cleaning agent 10 from carpet 27 and from roller rotating brushes 1-1 and 1-2, preventing secondary generation of foam, includes a vacuum pump 19 disposed on a defoaming tank 17. Vacuum pump 19 creates a vacuum suction on residual liquid foam cleaning agent 10 on carpet 27 via a duct 44 and a foam suction nozzle 15, which opens directly behind second roller rotating brush 1-2. Foam suction nozzle 15 further includes a dirt filter 40. Residual liquid foam cleaning agent 10 on carpet 27 and roller rotating brushes 1-1 and 1-2 is transferred to the bottom of defoaming tank 17 through foam suction nozzle 15 and duct 44.

Dirt filter 40 includes a first layer comprising a somewhat coarse material in rock form that uses a coarse fiber, and a second layer comprising a material having very fine continuous holes using plastic such as urethane foam. Dirt filter 40 prevents large debris from entering defoaming tank 17.

Defoaming tank 17 is filled with a defoaming solution 18 containing a defoaming agent such as silicone paste or 0.001–0.01 percent polyoxyalkyl glycol. Defoaming solution 18 fills defoaming tank 17 between approximately ¼ and ¾ of the volume of defoaming tank 17.

The foam that enters defoaming tank 17 is instantaneously neutralized and flattened by the action of defoaming solution 18 so that vacuum pump 19, located further downstream, is not contaminated.

The level of defoaming solution 18 within defoaming tank 17 goes up as a result of liquid foam cleaning agent 10 being sucked in. This causes a fluid level detection float 31 to raise. Eventually, the tip of fluid level detection float 31 contacts the upper surface of a fluid level detection switch 32. Solenoid valves 11-2, 11-3 are opened electronically, and Venturi nozzle 29 (shown in FIG. 4) is activated. The resulting negative pressure causes check valve 33-3 to open, and defoaming solution 18 flows from defoaming tank 17.

Conversely, if the fluid level in defoaming tank 17 drops below a fixed level, float 31 contacts a lower surface of detection switch 32. Solenoid valves 11-2 and 11-3 close as well as check valve 33-2. This stops the flow of defoaming liquid 18. Thus, the fluid level within defoaming tank 17 is maintained between a specific range.

The fluid level in defoaming tank 17 can be inspected at anytime from the outside using a fluid level meter 39-2.

An electronic foam detection device 36, inside defoaming tank 17, detects when foam is generated, or is not neutralized within defoaming tank 17. Based on the signal from electronic foam detection device 36, the fluid in defoaming tank 17 is manually released from lower drain 37, and defoaming tank 17 is filled with defoaming liquid 18 from a supply inlet 38, located on top of defoaming tank 17.

Besides the fluid level detecting means described above, other conventional mechanical means or manual means could also be used. For example, fluid level detection switch 32 could be connected to a light or other electronic device, providing a visual indication to the user of the status of defoaming solution 18. In another embodiment, the fluid level detecting means of the preferred embodiment is replaced by a system which is totally dependent on the users observations.

When two or more disc-shaped horizontal rotating brushes are used instead of the roller rotating brush described above, foam suction nozzle 15 is positioned directly behind the rearmost horizontal rotating brush, and residual foam from carpet 27 is suctioned in the same manner.

Water vapor in the air inside defoaming tank 17 is eliminated with a demister 16. To conserve energy, an exhaust valve 45 of vacuum pump 19 is optionally connected to the air suction portion of a high-speed turbo fan 21.

The exhaust from vacuum pump 19 and/or outside air from an air inlet 46 is used to instantaneously dry residual liquid foam cleaning agent 10 that may still remain on the cleaned surface of carpet 27. The outside air from air inlet 46 is passed through a filter 20 and is combined as necessary with the exhaust from vacuum pump 19 and passed on to turbo fan 21. The exhaust from turbo fan 21 is heated to between 70 degrees C. and 200 degrees C. using an electric heater 22 disposed within a second air duct 47. The heated air is then blown through a jet air nozzle 23 onto the surface of carpet 27. Jet air nozzle 23 accelerates the air to a velocity between approximately 4 and 20 m/sec. The resulting instantaneous drying of carpet 27 allows carpet 27 to be used immediately after cleaning.

The contact pressure between carpet 27 and roller rotation brushes 1-1 and 1-2, the gap between carpet 27 and foam suction nozzle 15, and the gap between jet air nozzle 23 and carpet 27 are all adjustable and can be set according to the type of carpet being cleaned.

Figure 6:
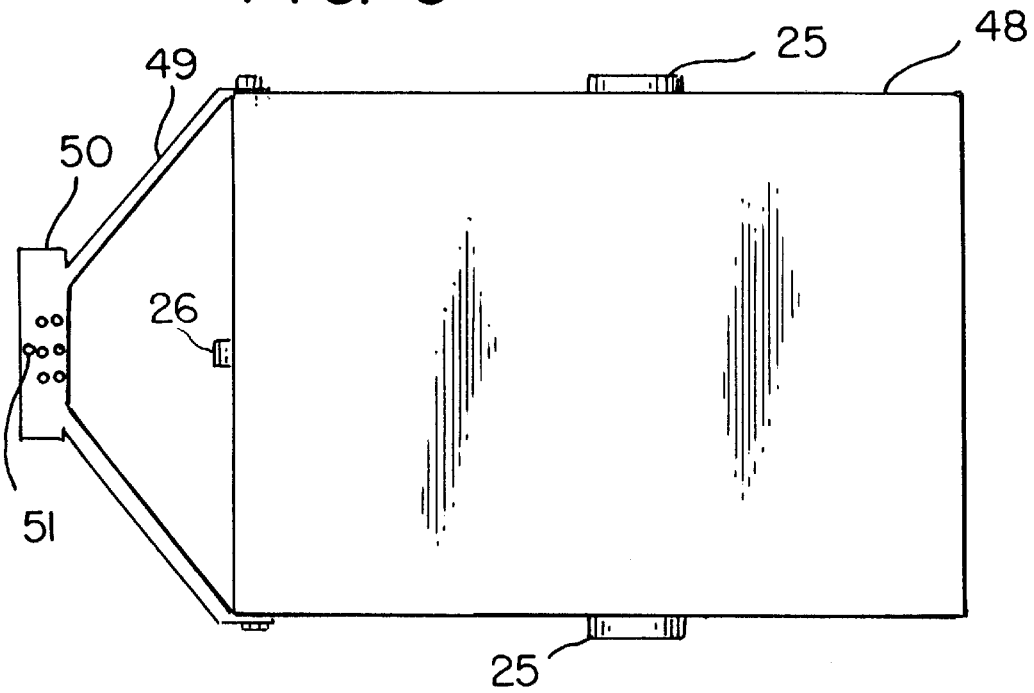
FIG. 6 is a top-view drawing of the carpet cleaning device of the present invention.

Referring now to FIGS. 1 and 6, carpet cleaner 41 of the present invention includes a plastic cover 48, which is screwed onto frame 24 at a number of points. This allows the cover to be easily removed.

On the top surface of an operating control panel 50, a main switch 51 operates the main power supply for carpet cleaner 41. The control panel also houses switches for heater 22, compressor 13, vacuum pump 19, geared motor 6, turbo fan 21, and solenoid valves 11-1, -2, and -3. The control panel 50 could also house any other switch for operating any of the other components of carpet cleaner 41.

Referring to FIG. 1, operating control panel 50 is formed integrally with a handle 49. Handle 49 is rotatably supported at the rear end of frame 24 with bolts such that the end of handle 49 housing operating control panel 50 moves up and down. Handle 49 allows carpet cleaner 41 to be pushed manually.

To operate carpet cleaner 41, main switch 51 for the power supply is turned on. Then, the switch for compressor 13, the switch for vacuum pump, the switch for geared motor 6, the switch for turbo fan 21 and the switch for electromagnetic valves 11-1, -2, and -3, are turned on. Cleaning agent foam is fed to the floor, and the carpet cleaning process is begun. Finally, the switch for heater 22 is turned on and the drying of the carpet is performed.

The carpet cleaner is turned off by turning off all the switches described above.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claim.

What is claimed is:

1. A cleaning device comprising:

means for movably supporting said cleaning device;

said cleaning device being movable in a direction of travel by said means for movably supporting;

means for applying a cleaning agent to a surface;

said means for applying a cleaning agent includes
means for transforming said cleaning agent into a foam;
means for applying said foam to said surface;
means for scrubbing said foam into said surface;

said means for scrubbing having brushes movably mounted on said chassis such that said brushes contact said surface;

means for moving said brushes relative to said surface;

said means for moving said brushes includes means for rotating said brushes;

said means for rotating being effective to rotate said brushes in opposing directions;

means for removing said foam from said surface;

said means for removing mounted on said cleaning device behind said means for scrubbing relative to said direction of travel;

means for drying said surface;

said means for drying including means for blowing air on said surface; and said means for drying mounted behind said means for removing relative to said direction of travel.

2. The cleaning device of claim 1, said means for movably supporting further comprising:

a prime mover and means for selectively starting and stopping said prime mover; and said prime mover being effective to urge said cleaning device in said direction of travel when said prime mover is started.

3. A cleaning device comprising:

means for movably supporting said cleaning device;

said cleaning device being movable in a direction of travel by said means for movably supporting;

means for applying a cleaning agent to a surface;

said means for applying a cleaning a gent includes
means for transforming said cleaning agent into a foam;
means for applying said foam to said surface;
means for scrubbing said foam into said surface;
means for removing said foam from said surface;

said means for removing mounted on said cleaning device behind said means for scrubbing relative to said direction of travel;

means for drying said surface;

said means for drying including means for blowing air on said surface;

said means for drying mounted behind said means for removing relative to said direction of travel;

said means for transforming including:
a foaming space;
means for transferring said cleaning agent to said foaming space;
means for mixing said cleaning agent with air in said foaming space to create said foam;
said foam being a multiplicity of air bubbles in said cleaning agent wherein a volume of said air per unit of said foam far exceeds a volume of said cleaning agent per unit of said foam, each air bubble of said multiplicity of air bubbles having a size;
a metal mesh;
said size of said air bubbles being reduced after passing through said metal mesh;
a sponge;
said size of said air bubbles being further reduced after passing through said sponge;
a duct connected to said foaming space; and
said duct housing said metal mesh and said sponge.

4. The cleaning device of claim 1, wherein said means for removing excess cleaning agent further includes:

a defoaming tank;

a foam suction nozzle running from said carpet to said defoaming tank; and means for creating a negative pressure in said foam suction nozzle.

5. The cleaning device of claim 1, wherein said means for drying further includes:

an air drying duct;

means for blowing air through said air drying duct toward said surface; and means for heating said air as said air passes through said air drying duct.

6. A carpet cleaner for cleaning a carpet comprising:

a chassis having wheels and casters;

a mechanism to urge said carpet cleaner in a direction of travel;

said wheels and casters being effective to permit said carpet cleaner to move in said direction of travel when said mechanism urges said chassis;

a cleaning agent tank mounted on said chassis;

a foam applicator;

a duct connecting said foam applicator and said cleaning agent tank;

means for transforming said cleaning agent into a foam;

said foam being a multiplicity of air bubbles in said cleaning agent wherein a volume of said air per unit of said foam far exceeds a volume of said cleaning agent per unit of said foam, each air bubble of said multiplicity of air bubbles having a size;

said means for transforming mounted in said duct;

means for discharging said foam from said foam applicator onto said carpet;

brushes movably mounted on said chassis;

means for moving said brushes relative to said carpet;

means for removing excess foam from said carpet;

a defoaming tank containing a defoaming solution;

said defoaming tank mounted on said chassis rearward from said brushes relative to said direction of travel;

a suction nozzle adjustably mounted on said chassis above said carpet;

a defoaming duct connecting said suction nozzle and said defoaming tank;

means for creating a negative pressure in said suction nozzle;

said defoaming tank having means for releasing excess defoaming solution from said defoaming tank;

means for drying said carpet mounted rearward from said means for removing excess foam relative to said direction of travel;

a handle;

said handle allowing manual movement of said carpet cleaner; and a control panel including controlling means for selectively starting and stopping said means for applying said foam, means for moving said brushes, means for removing excess foam, and means for drying said carpet.

7. The carpet cleaner of claim 6, wherein said means for releasing excess defoaming solution includes:

a release duct connected to said defoaming tank;

a venturi nozzle mounted between the ends of said duct;

means for creating air flow through a center of said venturi nozzle thereby pulling said defoaming solution out of said defoaming tank; and means for interrupting said means for releasing when a level of defoaming solution is below a predetermined setpoint.

8. The carpet cleaner of claim 6, wherein said means for transforming said cleaning agent includes:

a foaming space mounted in said duct below said cleaning agent tank;

means for blowing air into said foaming space at 2–3 $kg/cm^2$;

said means for blowing air creating said foam in said foaming space.

9. The carpet cleaner of claim 8, wherein said means for transforming further includes:

a metal mesh mounted in said duct below said foaming space;

said size of said air bubbles being reduced after passing through said metal mesh.

10. The carpet cleaner of claim 9, wherein said means for transforming said cleaning agent further includes:

a urethane sponge mounted in said duct below said metal mesh;

said size of said air bubbles being further reduced after passing through said urethane sponge.

11. The carpet cleaner of claim 6, wherein:

said carpet includes fibers; and said means for moving said brushes includes means for separating said fibers.

12. The carpet cleaner of claim 11 further including bristles on said brushes and said means for separating said fibers includes a specific arrangement of bristles on said brushes.

13. A carpet cleaner for cleaning carpets comprising:

a chassis;

means for applying a cleaning agent to said carpet;

said means for applying including means for transforming said cleaning agent into a foam, said foam being a multiplicity of air bubbles in said cleaning agent wherein a volume of said air per unit of said foam far exceeds a volume of said cleaning agent per unit of said foam, each air bubble of said multiplicity of air bubbles having a size;

means for reducing said size including a series of at least two porous elements arranged in a sequence;

each said at least two porous elements having pores of a defined pore size;

a first porous element of said at least two porous elements having a largest pore size;

each successive said porous element in said sequence after said first porous element having a smaller pore size than any said porous element preceding;

means for scrubbing said carpet;

suction means for removing excess cleaning agent from said carpet;

a compressor;

an air duct;

a heater;

means for directing air from said compressor to said heater effective to generate hot air; and means for blowing said hot air from said heater onto said carpet for drying said carpet.

14. The carpet cleaner of claim 13 wherein said means for applying said cleaning agent includes means for selectively releasing and interrupting said release of said foam.

15. The carpet cleaner of claim 13, wherein said means for transforming said cleaning agent into a foam includes:

a foaming space mounted in said duct below said cleaning agent tank;

means for blowing air into said foaming space at 2–3 $kg/cm^2$;

said means for blowing air creating said suds in said foaming space.

16. The carpet cleaner of claim 15, further including: said first porous element being a metal mesh mounted in said duct below said foaming space; and said size of said air bubbles being reduced after passing through said metal mesh.

17. The carpet cleaner of claim 16, further including: said subsequent porous element being a urethane sponge mounted in said duct below said metal mesh; and said size of said air bubbles being further reduced after passing through said urethane sponge.

18. The carpet cleaner of claim 13, wherein:

said carpet includes fibers; and said means for scrubbing includes means for separating said fibers from one another.

* * * * *